US009386368B2

(12) United States Patent
Johansen et al.

(10) Patent No.: US 9,386,368 B2
(45) Date of Patent: Jul. 5, 2016

(54) REMOTE SPEAKER MICROPHONE

(71) Applicant: OTTO ENGINEERING, INC., Carpentersville, IL (US)

(72) Inventors: Scott Ray Johansen, Aurora, IL (US); Jeffrey Alan Kennedy, Algonquin, IL (US); Joshua Britton Wawak, Algonquin, IL (US); Christopher Ole Yttri, Twin Lakes, WI (US); Alan Edmund Derdzinski, Belvidere, IL (US)

(73) Assignee: OTTO ENGINEERING, INC., Carpentersville, IL (US)

( * ) Notice: Subject to any disclaimer, the term of this patent is extended or adjusted under 35 U.S.C. 154(b) by 38 days.

(21) Appl. No.: 14/564,873

(22) Filed: Dec. 9, 2014

(65) Prior Publication Data

US 2015/0163588 A1 Jun. 11, 2015

Related U.S. Application Data

(60) Provisional application No. 61/914,190, filed on Dec. 10, 2013.

(51) Int. Cl.
*H04R 3/00* (2006.01)
*H04R 1/32* (2006.01)

(52) U.S. Cl.
CPC ..... *H04R 1/326* (2013.01); *H04R 2499/11* (2013.01)

(58) Field of Classification Search
CPC ..... H04R 3/005; H04R 1/406
USPC ..... 381/92
See application file for complete search history.

(56) References Cited

U.S. PATENT DOCUMENTS

| | | | | |
|---|---|---|---|---|
| 5,276,916 | A | 1/1994 | Pawlish et al. | |
| 5,701,355 | A | 12/1997 | Brannan et al. | |
| 5,850,613 | A * | 12/1998 | Bullecks | H04B 1/385 200/332 |
| D662,090 | S * | 6/2012 | Richards | D14/226 |
| D718,746 | S * | 12/2014 | Tran | D14/137 |
| 2007/0092097 | A1* | 4/2007 | Williams | H04R 1/023 381/355 |
| 2008/0242375 | A1* | 10/2008 | Garcia | H04B 1/3833 455/575.1 |
| 2008/0242383 | A1 | 10/2008 | Towns et al. | |
| 2009/0161900 | A1 | 6/2009 | Enstad et al. | |
| 2009/0196033 | A1* | 8/2009 | MacDonald | F21L 4/00 362/234 |
| 2010/0124957 | A1* | 5/2010 | Williams | A45F 5/02 455/575.6 |
| 2011/0059719 | A1* | 3/2011 | Spielvogel | G08B 25/016 455/404.1 |
| 2015/0131844 | A1* | 5/2015 | Qu | H04R 1/023 381/412 |

OTHER PUBLICATIONS

International Search Report and the Written Opinion of the International Searching Authority for PCT Application No. PCT/US2014/069333 mailed Apr. 15, 2015, 16 pages.

* cited by examiner

*Primary Examiner* — Simon King
(74) *Attorney, Agent, or Firm* — McAndrews, Held & Malloy, Ltd.

(57) ABSTRACT

A remote speaker microphone having a directional microphone, a speaker, and a housing. The housing has a first portion sized to contain the speaker and a second portion sized to contain the directional microphone. The second portion defines a front port positioned adjacent the front surface of the directional microphone and a rear port positioned adjacent the rear surface of the directional microphone. The housing is configured to minimize the distance that sound waves travel within the housing before impacting on the sound receiving surfaces of the microphone.

18 Claims, 5 Drawing Sheets

FIG. 9
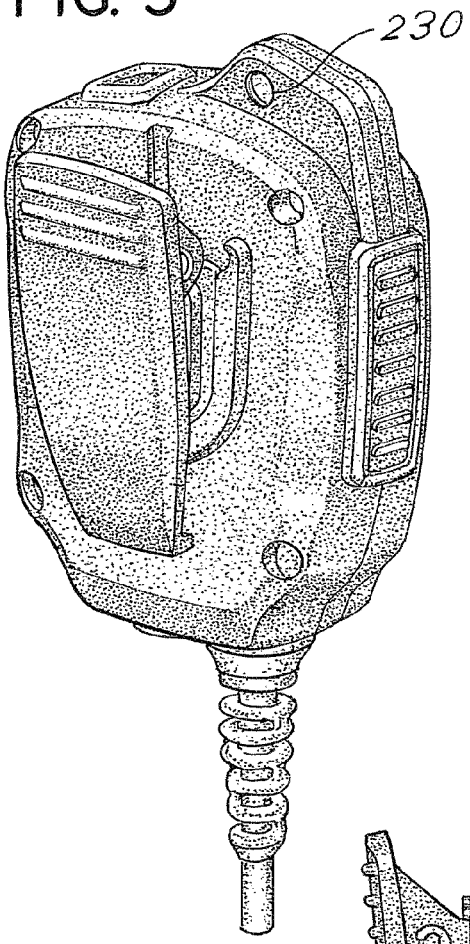
FIG. 10
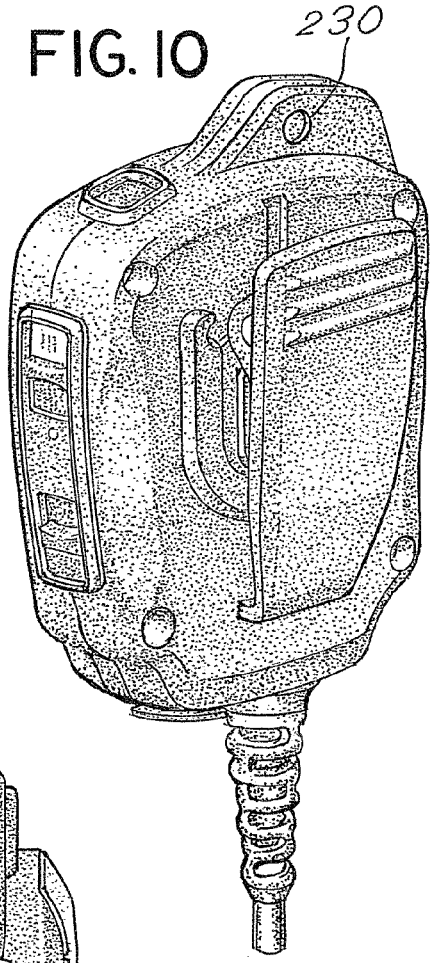
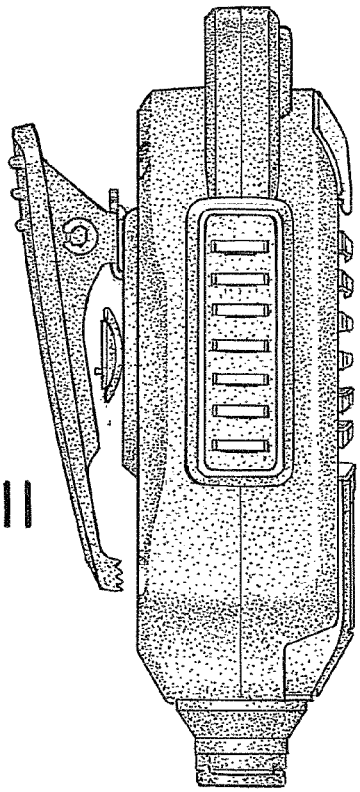
FIG. 11

REMOTE SPEAKER MICROPHONE

CROSS-REFERENCE TO RELATED APPLICATIONS

The present application claims priority under 35 U.S.C. §119(e) to provisional application Ser. No. 61/914,190, filed on Dec. 10, 2013, entitled REMOTE SPEAKER MICROPHONE, which is incorporated herein by reference in its entirety.

BACKGROUND

The present invention relates generally to a speaker microphone assembly for use with a communication device, and more particularly, relates to a remote speaker microphone (RSM) for use with a two-way radio.

Referring to FIG. 1, an RSM 100, according to the prior art, typically includes a housing 101 that carries a microphone 102 mounted within the housing and positioned facing outwardly from the front of the housing. A Push-To-Talk ("PTT") button 104 is mounted to the left side of the housing. A speaker 105 is mounted within the housing and positioned facing outwardly through the front of the housing. A louvered or shutter opening area 103 may be formed in the housing directly in front of speaker 105. A cable 106 extends downwardly from housing 101 to interconnect the RSM with a communication device (not shown) such as a two-way radio.

A directional microphone may be used in such an RSM and would utilize front and rear ports in the housing and serve to sense the difference between the instantaneous air pressures, which impinge on two diaphragm surfaces of the directional microphone. An internal delay at the rear port to a diaphragm surface is optimally designed to time and cancel the distance delay, thus allowing unwanted sound to reach the diaphragms from both ports simultaneously and therefore be cancelled.

The directional microphones that are typically used in RSMs are relatively small in comparison to the front-to-back thickness of the speakers that are used in RSMs. For example, a typical directional microphone element may be in the order of about 6 mm in diameter and about 5 mm thick (front to back). A typical RSM housing, on the other hand, may be on the order of about 25 mm thick (front to back). In known RSM devices, the housing size in general, and it's front-to-back thickness (i.e., its depth) in particular, is determined as a function of the size of the components positioned within the housing, as for example, a speaker, a printed circuit board ("PCB"), a PTT switch, an earphone jack, and any other internal components. Due to the physical size (or geometry) of the housing in relation to the directional microphone, known RSM devices include relatively large channels (cavities, or chambers) at the front and rear of the directional microphone.

For example, FIG. 2 illustrates a prior art mounting of a directional microphone 108 in an RSM housing 101. As shown in FIG. 2, directional microphone 108 is generally positioned midway between front and rear walls 110, 118 of RSM housing 101. A front channel 124 extends between a front port 112 of housing 101 and a front surface 114 of microphone 108. Likewise, a rear channel 126 extends between a rear port 116 of the housing and a rear wall 120 of microphone 108. However, due to the relatively small size of the microphone (e.g., thickness from front surface 114 to back surface 120) in comparison to the thickness of the housing (from front wall 110 to rear wall 118), the rear surface 120 of the microphone 108 is laterally spaced from the housing's rear wall 118 and rear port 116. As a result, sound waves passing through rear port 116 must travel through rear channel 126 (which is a cavity or chamber) in housing 101 before reaching rear surface 120 of microphone 108. The acoustic effect of channels, cavities, and chambers, such as those shown in FIG. 2, may significantly degrade the noise reduction properties of a directional microphone.

SUMMARY

A remote speaker microphone according to at least some embodiments of the present invention includes a directional microphone, a speaker, and a housing. The housing has a first portion sized to contain the speaker and a second portion sized to contain the directional microphone. The second portion of the housing defines a front port positioned adjacent the front surface of the directional microphone and a rear port positioned adjacent the rear surface of the directional microphone. In some embodiments, the distance between the inner end of the front port and the front surface of the microphone may be on the order of less than about 2 mm, and more particularly less than about 1.5 mm, and more particularly, less than about 1 mm. Likewise, in some embodiments, the distance between the inner end of the rear port and the rear surface of the microphone may be on the order of less than about 2 mm, and more particularly, less than about 1.5 mm, and more particularly, less than about 1 mm. According to some embodiments, the second portion of the housing may be configured to minimize the distance that sound waves travel within the housing before impacting on the sound receiving surfaces of the microphone. Put another way, the second portion of the housing may be constructed to minimize or eliminate any channels, cavities, or chambers between the sound ports and the sound receiving faces of the microphone.

In some embodiments, the thickness of the second portion of the housing may be substantially the same as the thickness of the microphone element. For example, in some embodiments, the thickness of the second portion is between 105% and 175% of the thickness of the directional microphone. In some particular embodiments, the directional microphone may have a thickness on the order of about 5 mm, while the second portion of the housing may have a thickness on the order of about 8.5 mm.

In some embodiments, the thickness of the second portion of the housing may be reduced in comparison to the thickness of the first portion. For example, in some embodiments, the thickness of the second portion is between 20% and 40% of the thickness of the first portion. In some particular embodiments, the first portion may have a thickness on the order of about 25 mm, while the second portion may have a thickness on the order of about 5 mm.

In some embodiments, the second portion may protrude from the first portion and be configured to provide a visual indication to the end user of the location of the directional microphone.

In some embodiments, the second portion may protrude from an upper end of the first portion. For example, in some embodiments, the second portion may protrude from the upper left, upper center or upper right end of the first portion. Depending on the application, the second portion may protrude from other locations, such as the bottom or side of the first portion, or may be embedded within the perimeter of the relatively thicker first portion.

In some embodiments, the directional microphone comprises an electret microphone. In other embodiments, the microphone is a dynamic element. In another embodiment, the microphone is a MEMS type.

Certain embodiments of the present technology relate to a speaker microphone assembly having at least one microphone, a speaker, and a housing. The housing has a first portion sized to contain the speaker and a second portion sized to contain the microphone. The first portion of the housing has a thickness that is greater than the thickness of the speaker, and the second portion of the housing has a thickness that is substantially the same as that of the at least one microphone.

According to at least some embodiments, the at least one microphone comprises a directional microphone having front and rear surfaces configured to receive sound waves, and the second portion of the housing includes front and rear ports positioned adjacent to the front and rear surfaces of the directional microphone, respectively.

BRIEF DESCRIPTION OF THE DRAWINGS

FIGS. 7-11 are additional views of the RSM of FIG. 3.

DETAILED DESCRIPTION

Figure 1:
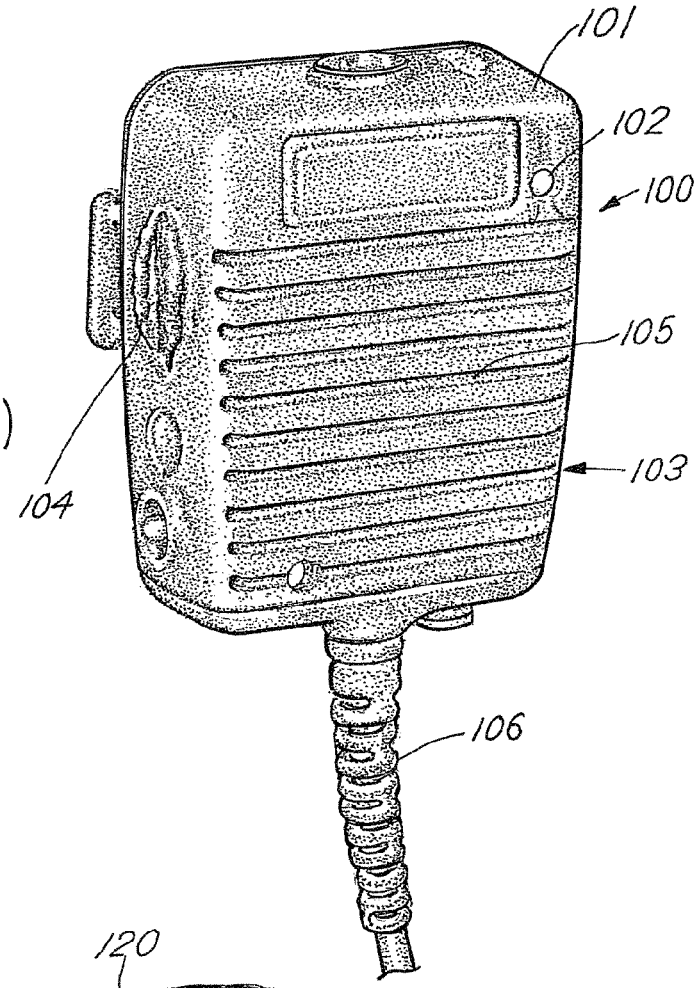
FIG. 1 (PRIOR ART)
FIG. 1 is a perspective view of an exemplary prior art RSM.
Figure 2:
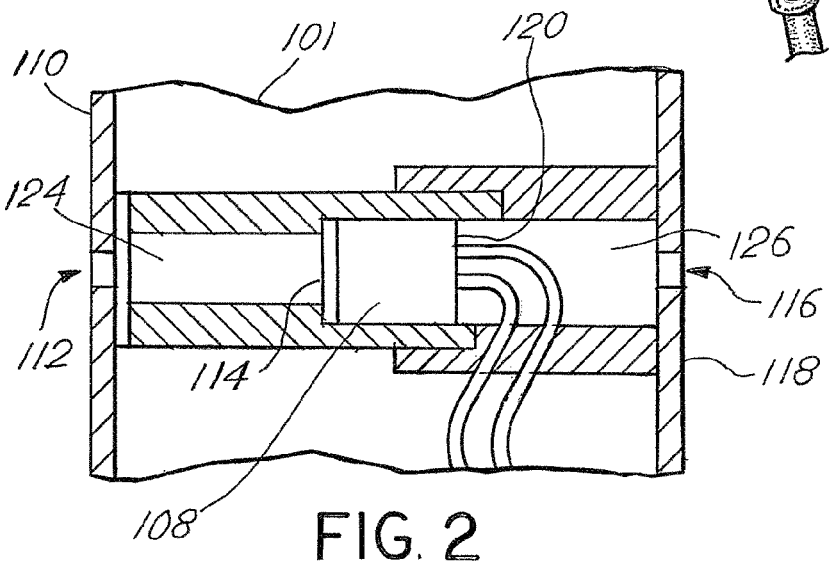
FIG. 2 (PRIOR ART)
FIG. 2 is a sectional view of a directional microphone in an RSM illustrating an exemplary prior art mounting of the directional microphone.
Figure 3:
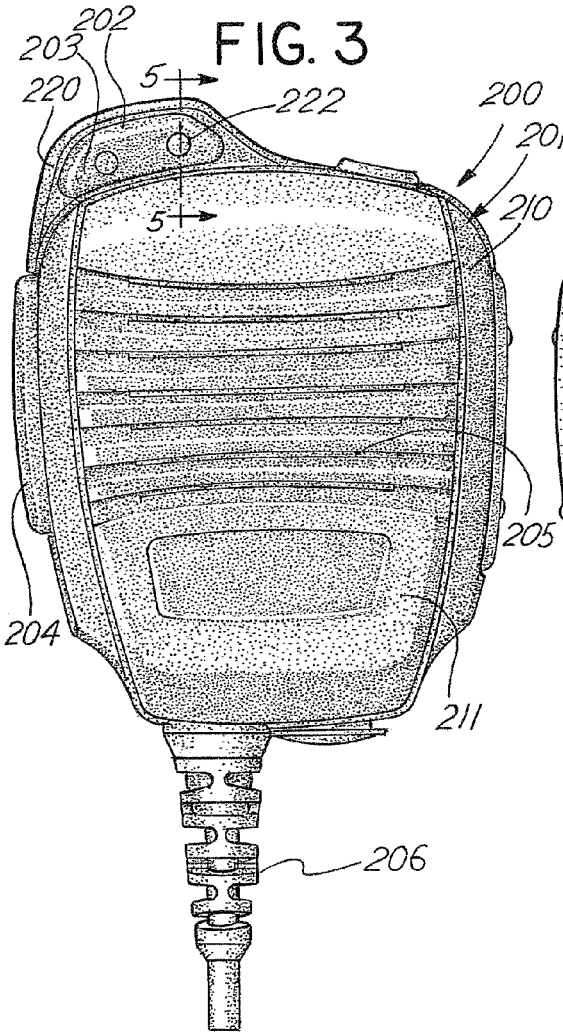
FIG. 3 is a front elevation view of an RSM in accordance with an embodiment of the present invention.

Referring to FIG. 3, a remote speaker microphone 200 is configured to interface with a communication device such as a two-way radio (not shown). In general, remote speaker microphone 200 includes a housing 201 that supports a microphone 202, a speaker 205, a control button 204, such as a push-to-talk ("PTT") button, and internal circuitry (not shown) for interfacing with the communication device. A cable 206 extends from housing 201 for interconnecting remote speaker microphone 200 with the communication device. The general operation of a remote speaker microphone is well understood in the art and, accordingly, will not be described in detail herein.

Figure 4:
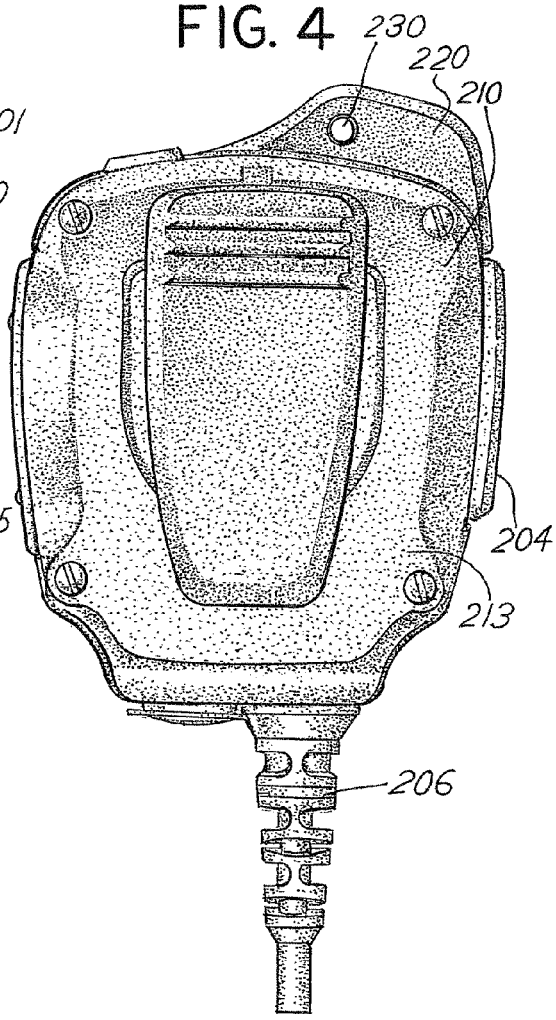
FIG. 4 is a rear elevation view of the RSM of FIG. 3.

Housing 201 includes a first portion 210 sized and configured to contain speaker 205. Housing first portion 210 has a thickness or depth (as measured between its front surface 211 and its rear surface 213 shown in FIG. 4) that is greater than the thickness of speaker 205 (as measured between the speaker's front and rear surfaces). First portion 210 of the housing may be sized and configured to house and support other components such as internal circuitry, for example. In addition, first portion 210 may be sized to fit into, or be gripped by, a single hand of the user. Alternatively, first portion 210 may be clipped to the lapel of the user's shirt collar.

Figure 5:
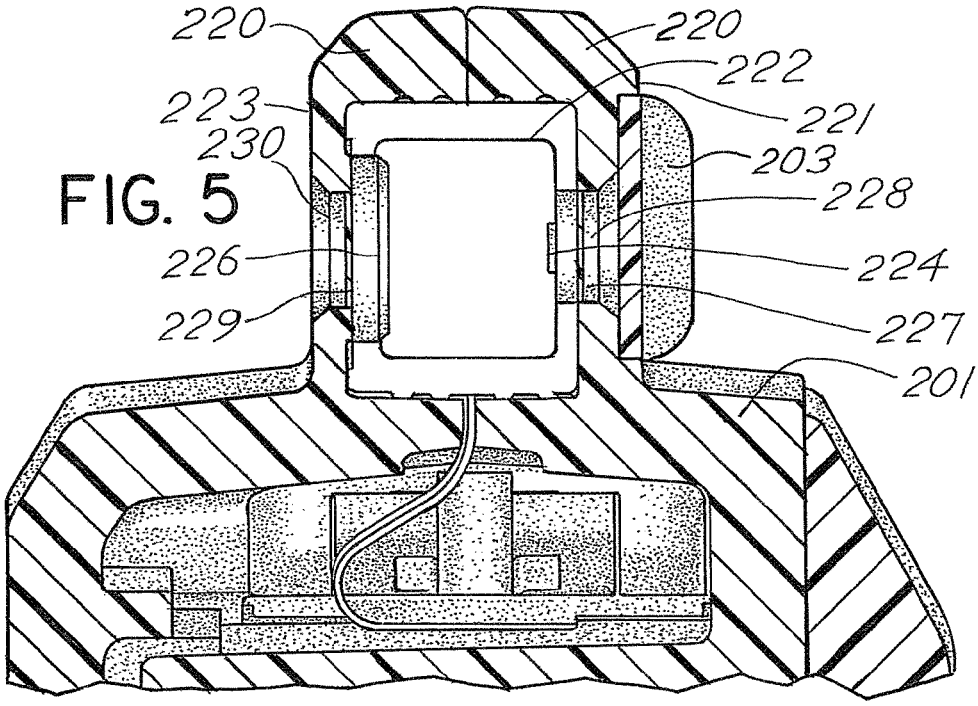
FIG. 5 is a partial sectional view of the RSM of FIG. 3 taken along line 5-5 of FIG. 3.
Figure 6:
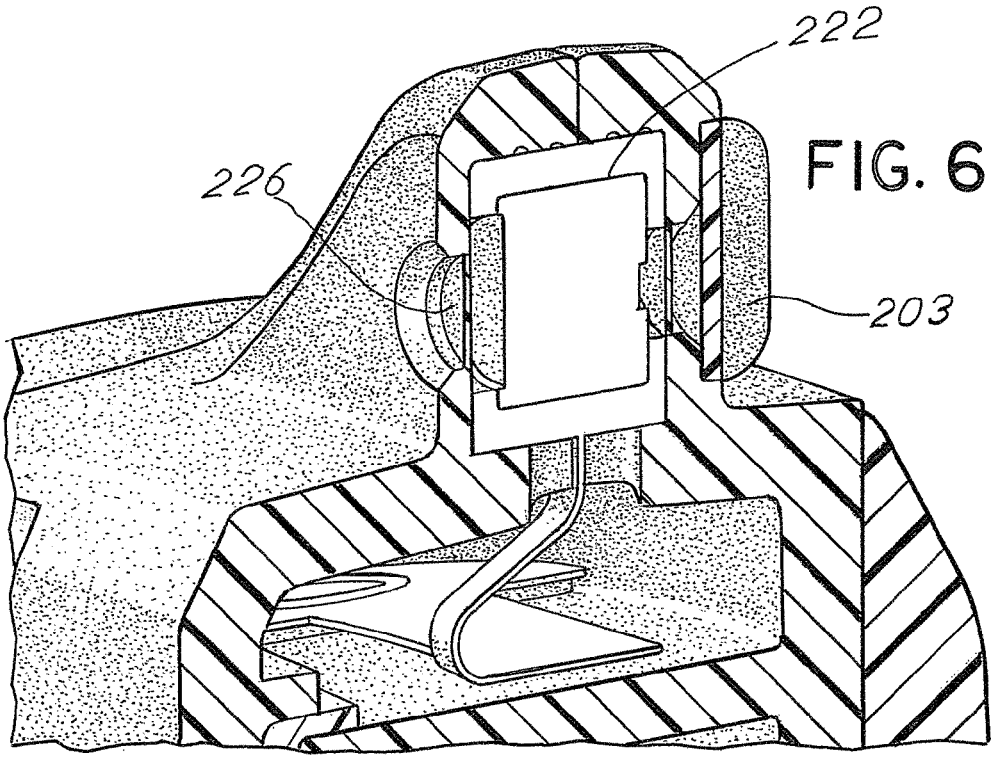
FIG. 6 is a perspective view of the partial sectional of the RSM of FIG. 5.
Figure 7:
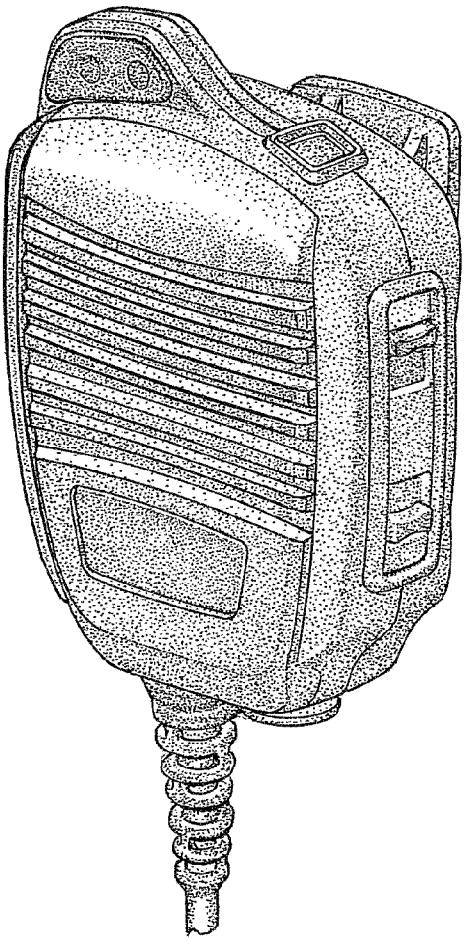
Figure 8:
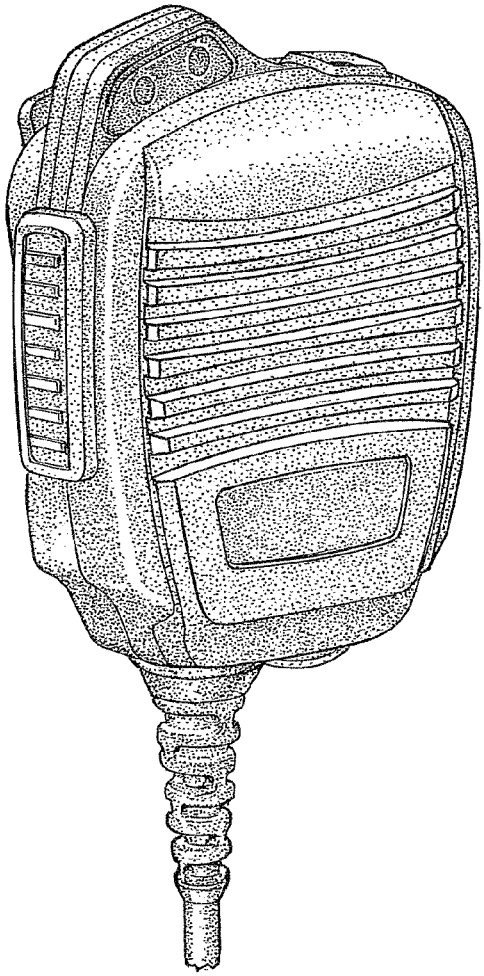

Housing 201 also includes a second portion 220 that is sized and configured to house microphone 202. A mesh-like screen or wind screen 203 may protrude outwardly, as shown in FIGS. 5 and 6, and serves to indicate to the user the location of microphone 202. According to some embodiments, remote speaker microphone 200 utilizes a directional microphone 222 and employs passive noise cancelling. In some embodiments, directional microphone 222 may be an electret microphone. Other suitable directional microphones include, for example, dynamic and MEMs.

Referring to FIG. 5, directional microphone 222 has a front surface 224 and a rear surface 226 configured to receive sound waves. In such embodiments, second portion 220 of the housing includes a front port 228 and a rear port 230. Ports 228, 230 are positioned adjacent respective front and rear surfaces 224, 226 of directional microphone 222. In some embodiments, the distance between the inner end 227 of front port 228 and front surface 224 of directional microphone 222 may be on the order of less than about 2 mm, and more particularly, less than about 1.5 mm, and more particularly, less than about 1 mm. Likewise, in some embodiments, the distance between the inner end 229 of the rear port 230 and rear surface 226 of directional microphone 222 may be on the order of less than about 2 mm, and more particularly, less than about 1.5 mm, and more particularly, less than about 1 mm.

According to some embodiments, second portion 220 may be configured to minimize the distance that sound waves travel within the housing before impacting on sound receiving surfaces 224, 226 of microphone 222. Put another way, the second portion may be constructed to minimize or eliminate any channels, cavities, or chambers between sound ports 228, 230 and respective sound receiving faces 224, 226 of microphone 222.

In some embodiments, the thickness of second portion 220 (as measured between its front surface 221 and its rear surface 223) may be substantially the same as (or only slightly larger than) the thickness of the directional microphone 222 (as measured between its front and rear surfaces 224, 226). In some embodiments, second portion 220 may be of a reduced size in comparison to first portion 210.

In some embodiments, second portion 220 may protrude from an upper end of first portion 210. For example, in some embodiments, second portion 220 protrudes from an upper left end of first portion 210. As will be appreciated, remote speaker microphones are often worn on the user's lapel. Accordingly, locating the microphone at the upper end of the housing will typically position the microphone in close proximity to the user's mouth. Further, by positioning the microphone in a protruding housing portion, the microphone's location is more readily apparent to the user than in devices where the microphone is located in the same housing portion as the speaker. Put another way, the protruding nature of the second portion provides a visual indication of the location of the microphone to the end user.

While this disclosure has been described as having exemplary embodiments, this application is intended to cover any variations, uses, or adaptations using the general principles set forth herein. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. A remote speaker microphone, comprising:

a directional microphone having front and rear surfaces configured to receive sound waves;

a speaker; and a housing, said housing comprising:

(1) a first portion having a first lateral depth of a size to contain said speaker within said first portion; and (2) a second portion having a second lateral depth smaller than said first lateral depth, said second portion being of a size to contain said directional microphone within said second portion, said second portion defining a front port and a rear port, the front surface of the directional microphone being positioned adjacent said front port and the rear surface of the directional microphone being positioned adjacent said rear port.

2. A remote speaker microphone as set forth in claim 1, wherein said first portion has an upper end; and said second portion protrudes upwardly from said upper end of said first portion.

3. A remote speaker microphone as set forth in claim 2, wherein said first portion has an upper left end and an upper right end; and said second portion protrudes from said upper left end of said first portion.

4. A remote speaker microphone as set forth in claim 1, wherein said second portion has a front surface and a rear surface, and said second portion has a thickness defined by the distance between the front and rear surfaces; and wherein the thickness of said directional microphone is defined by the distance between its said front and rear surfaces; and wherein the thickness of said second portion is substantially the same as the thickness of said directional microphone.

5. A remote speaker microphone as set forth in claim 4, wherein the thickness of said second portion is between about 105% and 175% of the thickness of the directional microphone.

6. A remote speaker microphone as set forth in claim 4, wherein the thickness of said second portion is between 20% and 40% of the thickness of the first portion.

7. A remote speaker microphone as set forth in claim 1, wherein said second portion is configured to provide a visual indication of the location of the directional microphone to an end user.

8. A remote speaker microphone as set forth in claim 1, and further comprising a push-to-talk button disposed on said first portion.

9. A remote speaker microphone as set forth in claim 1, wherein the positioning of said directional microphone within said second portion defines a zone of microphone sensitivity; and wherein said speaker has an axis of radiation; and wherein said second portion is disposed relative to said first portion so as to direct said zone of microphone sensitivity away from said axis of radiation of said speaker.

10. A remote speaker microphone as set forth in claim 1, wherein said directional microphone comprises an electret microphone.

11. A speaker microphone assembly, comprising:

a microphone having a front surface and a rear surface, said microphone having a first thickness corresponding to the distance between said front surface and said rear surface;

a speaker having a front surface and a rear surface, said speaker having a second thickness corresponding to the distance between said front surface and said rear surface, and wherein the second thickness of the speaker being greater than the first thickness of the directional microphone; and a housing configured to contain the speaker and the microphone, said housing having a first portion sized to contain the speaker and a second portion sized to contain the microphone;

and wherein the first portion has a thickness that is greater than the thickness of the speaker;

and wherein the second portion has a thickness that is substantially equal to the thickness of the microphone.

12. A speaker microphone assembly as set forth in claim 11, wherein said microphone comprises a directional microphone having front and rear surfaces configured to receive sound waves; and wherein said second portion defines a front port positioned adjacent the front surface of said directional microphone and a rear port positioned adjacent the rear surface of said directional microphone.

13. A remote speaker microphone apparatus as set forth in claim 11, wherein said directional microphone comprises an electret microphone.

14. A speaker microphone assembly as set forth in claim 11, wherein the thickness of said second portion is between about 105% and 175% of the thickness of said directional microphone.

15. A speaker microphone assembly as set forth in claim 11, wherein said second portion protrudes from an upper end of said first portion.

16. A speaker microphone assembly as set forth in claim 11, wherein said second portion protrudes from an upper left end of said first portion.

17. A speaker microphone assembly as set forth in claim 11, wherein said second portion protrudes from said first portion and is configured to provide a visual indication to a user of the location of said microphone.

18. A hand-held remote speaker microphone, comprising:

a directional microphone having front and rear surfaces configured to receive sound waves;

a speaker; and a housing containing said directional microphone and said speaker, said housing having a first portion for location of said speaker and a second portion for location of said directional microphone, said first portion having a first depth and being sized to contain said speaker, said second portion having a second depth substantially smaller than said first depth and being sized to contain said directional microphone, said second portion extending outwardly from said first portion and being secured thereto.

* * * * *